US005455552A

United States Patent [19]

Metsler

[11] Patent Number: 5,455,552

[45] Date of Patent: Oct. 3, 1995

[54] FERRITE COMMON MODE CHOKE ADAPTED FOR CIRCUIT BOARD MOUNTING

[75] Inventor: Alexander Metsler, Newton, Mass.

[73] Assignee: Steward, Inc., Chattanooga, Tenn.

[21] Appl. No.: 237,451

[22] Filed: May 3, 1994

[51] Int. Cl.[6] ..... H01F 15/02; H01F 27/30

[52] U.S. Cl. ..... 336/65; 333/185; 336/83; 336/96; 336/175; 336/233

[58] Field of Search ..... 333/12, 177, 181, 333/185; 336/83, 200, 223, 229, 65, 175, 233, 96, 181, 221

[56] References Cited

U.S. PATENT DOCUMENTS

| | | | |
|---|---|---|---|
| 3,750,069 | 7/1973 | Renskers | 336/83 |
| 4,249,229 | 2/1981 | Hester | 336/200 |
| 4,314,221 | 2/1982 | Satou et al. | 336/83 |
| 4,636,752 | 1/1987 | Saito | 333/185 |
| 4,656,451 | 4/1987 | Pomponio | 336/96 |
| 4,758,808 | 7/1988 | Sasaki et al. | 333/185 |
| 4,785,273 | 11/1988 | Doty | 336/61 |
| 4,845,452 | 7/1989 | Sasaki et al. | 336/200 |
| 4,975,671 | 12/1990 | Dirks | 336/65 |
| 5,119,059 | 6/1992 | Covi et al. | 336/175 |

FOREIGN PATENT DOCUMENTS 55-1188 1/1980 Japan .

OTHER PUBLICATIONS

Fair–Rite Products Corp., Fair–Rite Technical Paper–Choosing a Ferrite for the Suppression of EMI, 92–4, 1992.

Fair–Rite Products Corp., News From Fair–Rite Corp., Red Hot from the Kiln . . . Common Mode Surface Mount Bead.

*Primary Examiner*—Thomas J. Kozma

*Attorney, Agent, or Firm*—Allen, Dyer, Doppelt, Franjola & Milbrath

[57] ABSTRACT

A common mode choke has a generally rectangular ferrite body for surface mounting on a printed circuit board. First and second spaced apart slotted openings extend vertically between the top face and the bottom face of the ferrite body. At least one pair of electrical conductors extend along parallel paths from the bottom face through the first slotted opening to the top face, along a portion of the top face, and back down through the second slotted opening to the bottom face. One pair of opposing side faces preferably has lower portions extending outwardly past a plane of the bottom face to thereby serve as a support to mount the bottom face of the ferrite body in spaced relation from the circuit board. The electrical conductors may then extend outwardly from the bottom face of the ferrite body for electrical connection through corresponding openings of a circuit board or extend laterally outwardly for electrical connection to corresponding portions of the circuit board in a gull wing configuration. A continuous upstanding ridge may be formed around the periphery of the top face of the ferrite body and defines a recess at the top face of the ferrite body. A sealant may be positioned within the recess defined by the upstanding ridge for forming a continuous top face to facilitate automated handling of the common mode choke.

12 Claims, 5 Drawing Sheets

FERRITE COMMON MODE CHOKE ADAPTED FOR CIRCUIT BOARD MOUNTING

FIELD OF THE INVENTION

This invention relates to electromagnetic noise suppressors, and more particularly, to a ferrite common mode choke.

BACKGROUND OF THE INVENTION

Chokes are commonly used in electronic circuits to block signal frequencies above a desired range, while at the same time allowing DC or low frequency signals to pass. Thus, chokes have been employed to prevent electromagnetic interference (EMI) from disturbing various electronic devices. EMI is generated, for example, as a byproduct of switching regulators which have current and voltage waveforms with fast rise and fall times. Because switching regulators are typically contained in power supplies, EMI may be transmitted throughout an electronic device via power supply conductors. Excessive EMI can lead to logic errors in a computer and can cause interference with other adjacent electronic components.

A choke is typically provided by a magnetic core through which, or around which, conductors or windings are positioned. Thus, a typical choke defines first and second mutually coupled magnetic paths. A choke may be schematically represented as a low pass filter. For any choke to function as intended, its inductance or inductive reactance, should not fall below a specific minimum, even though the current in a winding rises to a maximum value. Beyond the maximum current value, the reactance falls off appreciably. Thus, the choke's ability to impede interference signals drops, thereby allowing passage of these signals. It is therefore desirable to prevent the choke from being driven into saturation.

Ferrite materials are commonly used as the core material for many chokes because, among other reasons, ferrites have sensitive magnetic-frequency relationships. The ferrite material used to form the choke will determine which signal frequencies the choke will attenuate. Most ferrites having suitable inductance values for choke applications saturate at less than about 4,000 Gauss. Accordingly, when configured differentially, ferrites have a relatively low current carrying capacity at low frequencies before the choke is driven into saturation and its impedance level deteriorates at a desired frequency.

The techniques normally used to prevent this saturation are to provide a core air gap, use a larger cross-section core, or simply limit the allowable current. An example of a choke with a core air gap is illustrated in U.S. Pat. No. 5,115,059 to Covi et al. The choke described by Covi et al. is used for suppressing both differential and common mode noise on DC power supply conductors. The choke includes two complementary E-shaped ferrite halves mutually defining a pair of slots through which the conductors pass.

One style of ferrite noise suppressor includes individual electrical conductors extending through respective individual openings in a ferrite body, as shown, for example, by U.S. Pat. No. 4,758,808 to Sasaki et al. U.S. Pat. No. 4,785,273 to Doty discloses a transformer with a generally cylindrical ferrite body having a pair of opposing slots extending therethrough. A stripline formed by a pair of planar conductors extends through the slots.

If the electrical conductors are configured for common mode operation, then saturation problems can be mitigated or averted. In other words, bringing the high side and ground return through the same core annulus produces opposing fields in the core which tend to cancel. For example, large ferrite sleeves have been installed surrounding parallel input/output conductors and are able to function in this manner to suppress EMI entering or exiting .an electronic device. The parallel conductors create electric fields in the ferrite sleeve which tend to cancel each other. In other words, a common mode choke configuration allows a choke to function with high currents which would saturate a differential choke.

Chokes are commonly applied directly to printed circuit (pc) boards. However, it is not feasible to use chokes with large cores or a gapped section for pc board applications, rather, ferrite beads may commonly be used on individual conductors. Similarly, U.S. Pat. No. 4,656,451 to Pomponio discloses two stacked ferrite beads, with the ferrite for each bead selected to impede a different signal frequency. Two parallel passageways extend longitudinally through both beads and a U-shaped conductor is inserted into the two passageways. Such ferrite beads are very effective in pc board applications unless the current becomes greater than a saturation level. This condition is frequently the case in power supplies or converters where individual conductors (differentially) may handle several amperes.

In applications where common mode filtering of high speed signals is required as, for example, in twisted pair Ethernet networking signals, series ferrite beads have no ability to filter signals based on the mode of the signal traveling along a pair of conductors. Intended signal currents are usually defined as in a differential mode, where signal currents are equal in magnitude and opposite in direction on the pair of conductors. Unintended or noise currents are generally common mode, that is, the currents are equal in magnitude and flow in the same direction. Because of their construction, series ferrite beads cannot distinguish between these intended and unintended signals. Instead, both the intended differential mode signal current and the unintended common mode noise current encounter an impedance.

SUMMARY OF THE INVENTION

In view of the foregoing background, it is therefore an object of this invention to provide a board mountable, ferrite common mode choke for large signal currents, while being compact in volume and having a compact footprint.

It is another object of this invention to provide a common mode choke for high speed signals that reduces common mode noise signals while allowing intended differential signals to pass therethrough.

These and other objects, features, and advantages of the present invention are provided by a common mode choke including a ferrite body, for surface mounting on a printed circuit board, and including at least one pair of conductors extending through one or more slotted openings in the ferrite body. The ferrite body is preferably generally rectangular having a top face, a bottom face, and first and second pairs of opposing side faces. At least one slotted opening extends through the ferrite body. Preferably, first and second spaced apart slotted openings extend vertically between the top face and the bottom face, with the bottom face adapted to be positioned adjacent the circuit board. The slotted openings preferably extend adjacent respective ones of the opposing side faces and have a uniform generally rectangular cross-section.

The electrical conductors are laterally spaced apart from one another and extend along parallel paths from the bottom face through the first slotted opening to the top face, along a portion of the top face between the first and second slotted openings, and back down through the second slotted opening to the bottom face. Thus, the conductors cooperate with the ferrite body to define a common mode choke. In one embodiment, end portions of the electrical conductors may extend outwardly from the bottom face of the ferrite body to be electrically connected through corresponding openings of the circuit board.

The second pair of opposing side faces may have lower portions extending outwardly past a plane of the bottom face to thereby serve as a support to mount the bottom face of the ferrite body in spaced relation from the circuit board. Accordingly, in another embodiment, the electrical conductors may extend laterally outwardly from a pair of opposing side faces to be electrically connected to corresponding adjacent portions of the circuit board in a gull wing configuration.

The common mode choke preferably includes a continuous upstanding ridge formed around the periphery of the top face of the ferrite body. The upstanding ridge extends outwardly to at least a top surface of the electrical conductors and defines a recess at the top face of the ferrite body. A sealant preferably fills the recess defined by the upstanding ridge to form a smooth and continuous top face to facilitate automated handling of the common mode choke.

A method for making a common mode choke according to the invention includes the steps of: forming a ferrite body having a top face and a bottom face with a slotted opening extending through the ferrite body, and positioning at least one pair of electrical conductors in spaced apart relation along parallel paths from the bottom face through the slotted opening and back down to the bottom face so that the electrical conductors cooperate with the ferrite body to define a common mode choke.

The forming of the ferrite body preferably includes a step of forming lower portions of the ferrite body to extend outwardly past a plane of the bottom face to thereby serve as a support and adapt the bottom face of the ferrite body for mounting in spaced relation from a circuit board. Accordingly, the method may also include the step of bending end portions of the conductors to extend laterally outwardly from a pair of opposing side faces so as to adapt the electrical conductors for electrical connection to corresponding portions of a circuit board in a gull wing configuration.

The method may also include forming a second slotted opening which extends through the ferrite body and is spaced apart from the first slotted opening. Accordingly, the step of positioning the conductors thus preferably includes positioning the electrical conductors in spaced apart relation along parallel paths from the bottom face through the first slotted opening, along a portion of the ferrite body between the first and second slotted openings, and back through the second slotted opening to the bottom face.

The method also preferably includes the step of forming a continuous upstanding ridge which extends outwardly to at least a top surface of the electrical conductors and around the periphery of the top face of the ferrite body to define a recess at the top face of the ferrite body. Consequently, the step of positioning a sealant within the recess defined by the upstanding ridge results in forming a continuous top face which facilitates automated handling of the common mode choke.

DETAILED DESCRIPTION OF PREFERRED EMBODIMENTS

Figure 1:
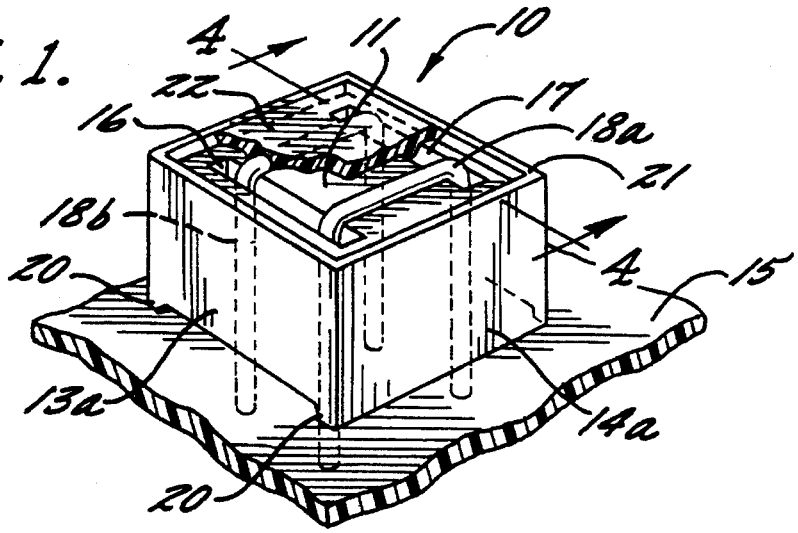
FIG. 1 is a fragmentary perspective view of a common mode choke according to the invention mounted on a printed circuit board.

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. Prime notation is used to indicate similar elements in alternate embodiments.

Referring first to FIGS. 1–4, a first embodiment of a common mode choke according to the invention, referred to generally by the numeral 10, includes a generally rectangular monolithic ferrite body having a top face 11, a bottom face 12, and two pairs of opposing side faces 13*a* and 13*b*, 14*a*, and 14*b*, respectively. The generally rectangular shape establishes parallel planes between the top face 11 and bottom face 12 and facilitates automated handling and mounting of the choke 10, such as to a printed circuit board 15. The footprint of the choke 10 is preferably rectangular and more preferably square, to provide greater flexibility for placement on the circuit board 15. The ferrite material is selected to provide particular impedance characteristics for specific operating frequencies as would be readily appreciated by those skilled in the art.

Figure 2:
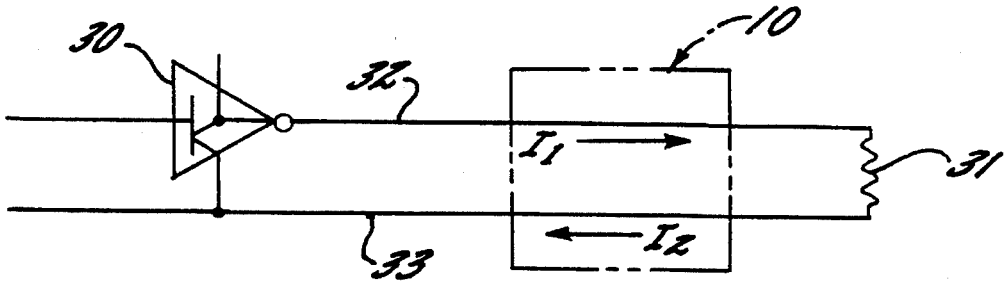
FIG. 2 is a schematic representation of the common mode choke of FIG. 1 in an electronic circuit.
Figure 3:
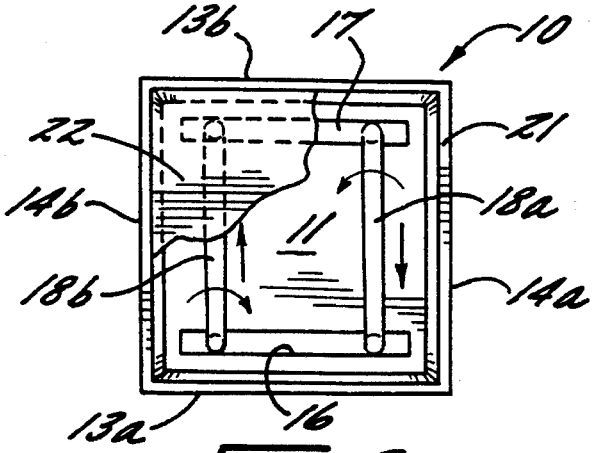
FIG. 3 is a plan view of the common mode choke illustrated in FIG. 1 with a portion of the sealant removed for clarity.

FIG. 2 is a schematic representation of the common mode choke 10 illustrated in FIG. 1. A signal generator 30 is connected to a load 31 by high side and ground return conductors 32, 33 respectively. As indicated by currents $I_1$ and $I_2$, the conductors 18*a*, 18*b* which pass through the ferrite body of the common mode choke 10, create magnetic fields which tend to cancel.

In the illustrated embodiment, a pair of slotted openings 16, 17 extend vertically between the top face 11 and bottom face 12 and are respectively adjacent opposite side faces 13*a*, 13*b* of the body. Alternatively, a single slotted opening extending either vertically or horizontally through the ferrite body may also be used. The illustrated embodiment includes two slotted openings 16, 17 to provide a longer conductor path through the ferrite material than a single path. In other embodiments, more slotted openings may be provided. The slotted openings 16, 17 desirably have a uniform cross-section and extend perpendicularly between the bottom face 12 and the top face 11 to facilitate manufacturing.

A pair of electrical conductors 18*a*, 18*b*, such as flat or round wires, extend along parallel paths from the bottom face 12 through the first slotted opening 16 to the top face 11, along a portion of the top face 11 between the first and second slotted openings, and back down through the second slotted opening 17 to the bottom face 12. The first and second spaced apart slotted openings 16, 17 have a width substantially equal to a corresponding dimension of the electrical conductors 18*a*, 18*b* to hold the electrical conductors within the slotted openings. The conductors 18*a*, 18*b* are laterally spaced from one another in each of the slots and extend outwardly from the bottom face 12 of the choke 10. Thus, the pair of electrical conductors 18*a*, 18*b* operate in a common mode configuration with the ferrite body material serving as the core.

Figure 4:
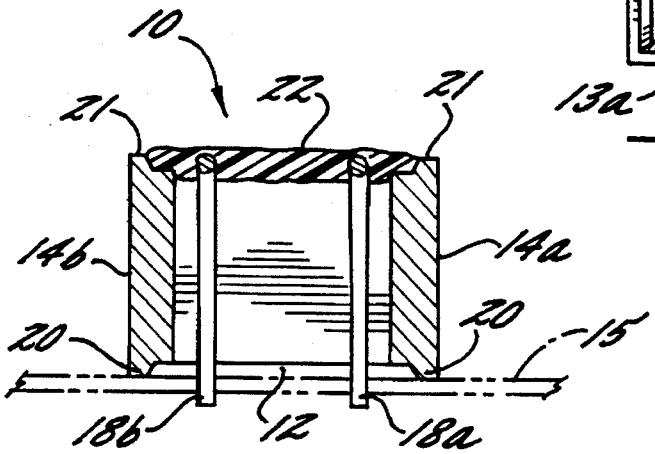
FIG. 4 is a sectional view taken along the lines 4—4 of FIG. 1.
Figure 5:
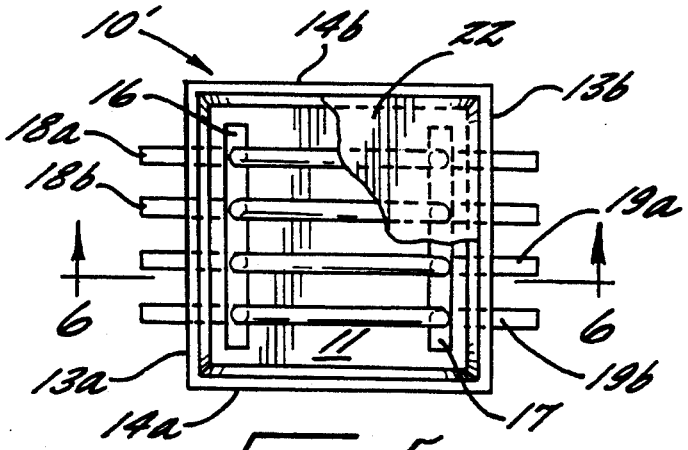
FIG. 5 is a plan view of a second embodiment of a common mode choke according to the invention with a portion of the sealant removed for clarity.
Figure 6:
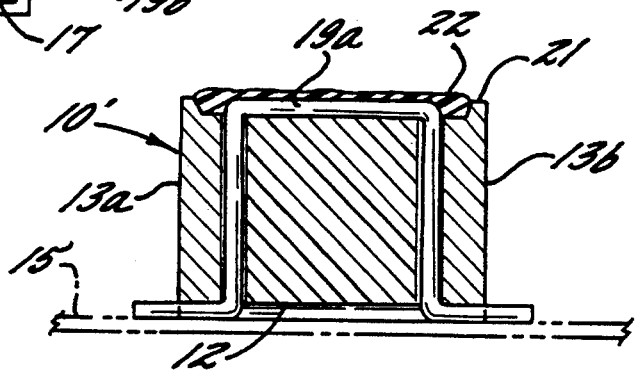
FIG. 6 is a sectional view taken along the lines 6—6 of FIG. 5.

Referring now briefly to FIGS. 5 and 6, a second embodiment of the choke 10' is illustrated, having two pairs of conductors 18*a*, 18*b*, 19*a*, and 19*b*, and being adapted for gull wing mounting. Lower side portions 20 of the ferrite body preferably extend outwardly past a plane of the bottom face 12 to thereby serve as supports 20 to mount the bottom face 12 of the ferrite body in spaced relation from the circuit board 15. The ends of the electrical conductors 18*a*, 18*b*, 19*a* and 19*b* extend laterally outwardly from respective sides of the ferrite body 10 so as to be adapted to be electrically connected to corresponding portions of the circuit board 15 in a gull wing configuration. In another configuration, as shown in FIG. 4, the conductors extend directly outwardly from the bottom face 12 for through-board mounting.

Figure 7:
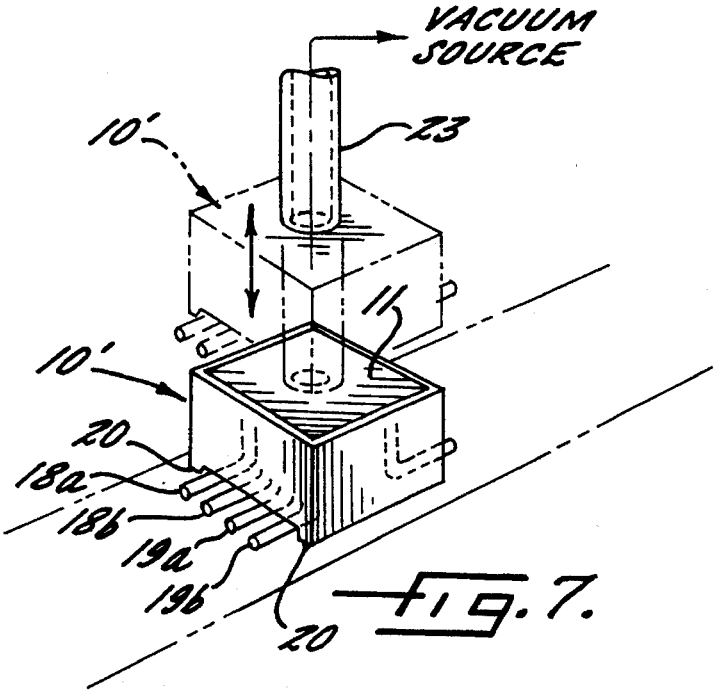
FIG. 7 is a perspective view of the second embodiment of the common mode choke being positioned by an automatic assembly tool.

Another feature of the common mode choke 10 is a continuous upstanding ridge 21 which is integrally formed along a periphery of the top face 11 of the ferrite body. The ridge 21 extends vertically at least to a top surface of the electrical conductors. The ridge 21 protects the conductors and, moreover, defines a recess into which, for example, a sealant such as an epoxy 22 may be poured and hardened. Thus, the conductors are secured in the ferrite body 10 by the epoxy 22. In addition, the sealed top face 11 permits vacuum-type automatic placement equipment 23 to be used to position the common mode choke on the printed circuit board 15 as shown in FIG. 7.

Figure 8:
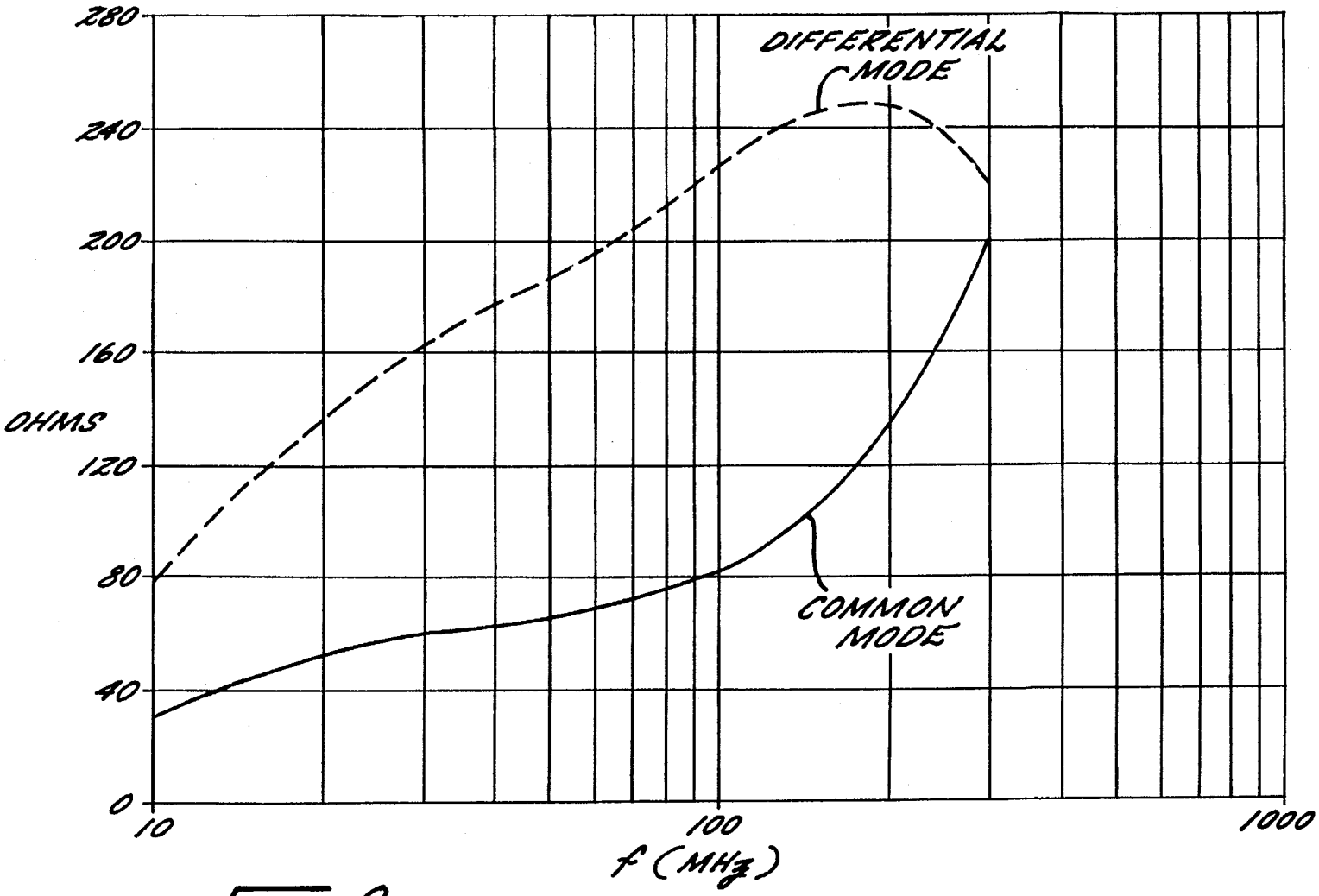
FIG. 8 is a graph of impedance verses frequency for a common mode choke according to the invention.

Referring to FIG. 8, there is illustrated a graphical comparison of two chokes made from the same ferrite material of the same physical size, one being a differential mode choke and the other a common mode choke 10 according to the invention. The impedance verses frequency comparison illustrated in FIG. 8 shows that the common mode choke 10 is a superior low-pass noise filter. Below 100 MHz, the common mode choke 10 is flatter than its differential counterpart. Above 100 MHz, the common mode choke 10 offers a steeper rise in impedance than the differential mode choke.

Figure 9:
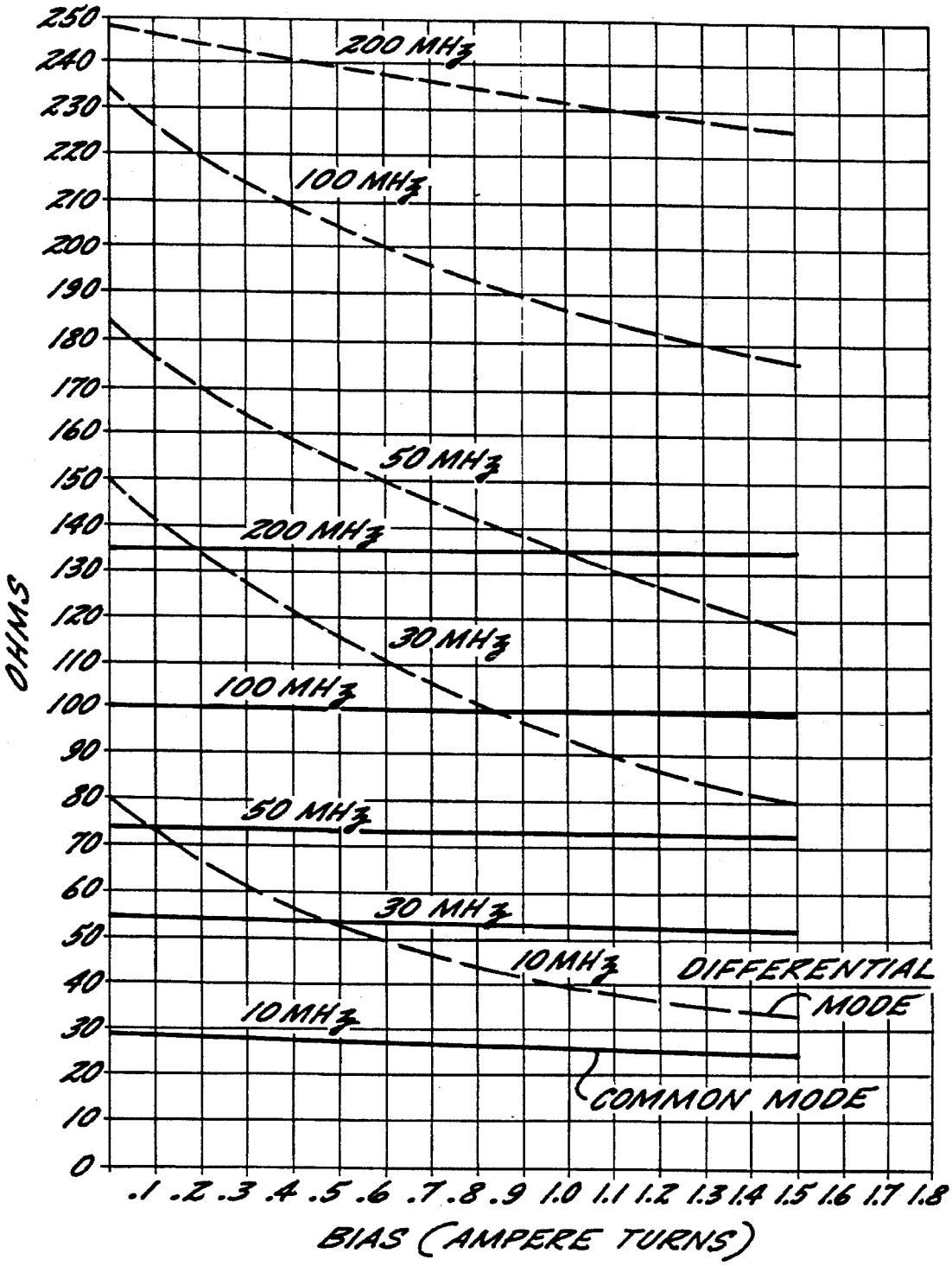
FIG. 9 is a graph of impedance verses frequency and with DC bias added.

FIG. 9 illustrates the effect of adding DC bias to the two chokes discussed in relation to FIG. 8 in a frequency range of 10 MHz–200 MHz. As current is increased, the impedance of the differential mode choke falls, while the impedance of the common mode choke 10 is more uniform. This effect is particularly apparent in the 10 MHz–50 MHz frequency range based upon the specific ferrite material.

Figure 10:
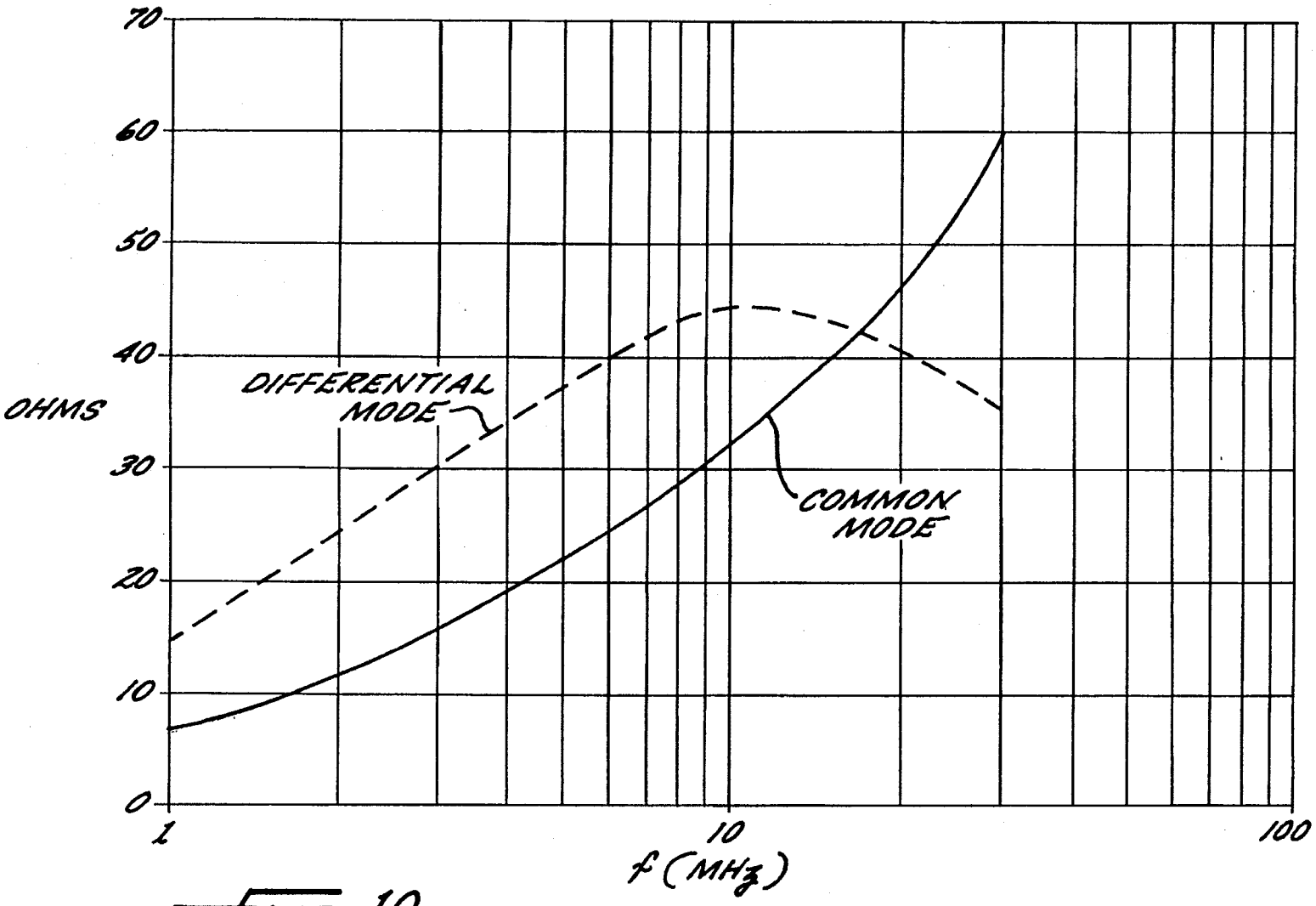
FIG. 10 is a graph of frequency verses impedance for another common mode choke using lower frequency ferrite.

Using lower frequency ferrites for the two chokes results in a further contrast between the differential mode choke and the common mode choke 10, as illustrated in FIG. 10. Above 10 MHz, the differential mode choke actually drops in impedance value as the differential choke enters saturation, while the impedance of the common mode choke 10 increases in a relatively uniform manner.

In applications where common mode filtering of high frequency signals is required, a common mode ferrite choke 10 can provide mode filtering, that is, a filter function based on the mode of the signal traveling along the circuit conductors. By virtue of its construction, the common mode choke 10 can distinguish between the intended and unintended signals based upon their net current directions. Intended differential mode signal currents that have equal magnitude and opposite direction are substantially unaffected by the choke 10. Unintended common mode noise signal currents that have equal magnitude and equal direction encounter a common mode impedance. Thus, only noise energy is attenuated by the common mode choke 10.

A preferred method of making a common mode choke 10 according to the invention includes the step of forming a ferrite body which has at least one slotted opening extending through it and has a bottom face adapted to be positioned adjacent a circuit board. A subsequent step involves positioning at least one pair of electrical conductors in laterally spaced relation along parallel paths from the bottom face 12 through the slotted opening and back down to the bottom face 12 so that the electrical conductors cooperate with the ferrite body to define a common mode choke.

The step of forming the ferrite body preferably includes forming a generally rectangular ferrite body having a top face 11, a bottom face 12, and first and second pairs of opposing side faces 13*a*, 13*b*, 14*a* and 14*b*, with first and second spaced apart slotted openings 16, 17 extending vertically between the top face 11 and the bottom face 12. The forming step also preferably includes forming lower portions 20 of the second pair of opposing side faces 14*a*, 14*b* which extend outwardly past a plane of the bottom face 12 to thereby serve as a support for mounting the ferrite body with the bottom face 12 in spaced relation from the circuit board 15. Accordingly, the positioning step preferably includes extending end portions of the electrical conductors laterally outwardly from the first pair of the opposing side faces 13*a*, 13*b* for electrical connection to corresponding adjacent portions of the circuit board 15 in a gull wing configuration.

The method also preferably includes the step of forming a continuous upstanding ridge 21 around the periphery of the top face 11 of the ferrite body which extends outwardly to at least a top surface of the electrical conductors and thereby defines a recess at the top face of the ferrite body. A subsequent step includes positioning a sealant 22 within the recess to form a continuous top face 11 for facilitating automated handling of the common mode choke 10.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A common mode choke adapted to be mounted on a circuit board, said common mode choke comprising:

a generally rectangular monolithic ferrite body having a top face, a bottom face, and first and second pairs of opposing side faces, said ferrite body further having first and second spaced apart slotted openings extending vertically between the top face and the bottom face, the second pair of opposing side faces having integrally formed lower portions extending outwardly past a plane of the bottom face to thereby serve as a support to mount the bottom face of the ferrite body in spaced relation from the circuit board; and at least one pair of electrical conductors laterally spaced apart from one another and extending continuously along parallel paths from said bottom face through the first slotted opening to said top face, along a portion of said top face between the first and second slotted openings, and back down through the second slotted opening to said bottom face so that said at least one pair of electrical conductors cooperate with said ferrite body to define a common mode choke, said at least one pair of electrical conductors extending laterally outwardly from the first pair of said opposing side faces so as to be adapted for electrical connection to corresponding adjacent portions of the circuit board in a gull wing configuration.

2. A common mode choke according to claim 1 wherein said first and second spaced apart slotted openings extend adjacent respective ones of the first pair of opposing side faces.

3. A common mode choke according to claim 1 wherein said first and second spaced apart slotted openings have a uniform generally rectangular cross-section and extend perpendicularly between the bottom face and the top face of said ferrite body.

4. A common mode choke according to claim 1 further comprising a continuous upstanding ridge integrally formed around the periphery of the top face of said ferrite body and extending outwardly to at least a top surface of said at least one pair of electrical conductors thereby defining a recess at the top face of said ferrite body.

5. A common mode choke according to claim 4 further comprising sealing means positioned within the recess defined by said upstanding ridge for forming a continuous top face to facilitate automated handling of the common mode choke.

6. A common mode choke according to claim 1 wherein said first and second spaced apart slotted openings have a width substantially equal to a corresponding dimension of said electrical conductors to hold said electrical conductors within the slotted openings.

7. A common mode choke adapted to be mounted on a circuit board, said common mode choke comprising:

a monolithic ferrite body having a top face and a bottom face, said ferrite body further having first and second spaced apart slotted openings extending vertically between the top face and the bottom face, the bottom face adapted to be positioned adjacent the circuit board;

at least one pair of electrical conductors laterally spaced apart from one another and extending continuously along parallel paths from said bottom face through the first slotted opening to said top face, along a portion of said top face between the first and second slotted openings, and back down through the second slotted opening to said bottom face so that said at least one pair of electrical conductors cooperate with said ferrite body to define a common mode choke;

a continuous upstanding ridge integrally formed around the periphery of the top fade of said ferrite body and extending outwardly to at least a top surface of said at least one pair of electrical conductors and defining a recess at the top face of said ferrite body; and sealing means positioned within the recess defined by said upstanding ridge for forming a continuous top face to facilitate automated handling of the common mode choke.

8. A common mode choke according to claim 7 wherein the bottom face has lower portions extending outwardly past a plane of the bottom face to thereby serve as a support to mount the bottom face of the ferrite body in spaced relation from the circuit board.

9. A common mode choke according to claim 8 wherein said at least one pair of electrical conductors extend laterally outwardly from said ferrite body so as to be adapted for electrical connection to corresponding adjacent portions of the circuit board in a gull wing configuration.

10. An electronic circuit comprising:

a circuit board;

a common mode choke mounted on said circuit board, said common mode choke comprising, a monolithic ferrite body mounted on said circuit board and having a top face, side faces, and a bottom face, said ferrite body further having first and second spaced apart slotted openings extending vertically between the top face and the bottom face, integrally formed lower portions of side faces of said ferrite body extending outwardly past a plane of the bottom face to thereby serve as a support to mount the bottom face of the ferrite body in spaced relation from the circuit board, and at least one pair of electrical conductors laterally spaced apart from one another and extending continuously along parallel paths from said bottom face through the first slotted opening to said top face, along a portion of said top face between the first and second slotted openings, and back down through the second slotted opening to said bottom face so that said at least one pair of electrical conductors cooperate with said ferrite body to define a common mode choke, said at least one pair of electrical conductors extending laterally outwardly from adjacent side faces of said ferrite body and electrically connected to corresponding portions of said circuit board in a gull wing configuration.

11. An electronic circuit according to claim 10 further comprising a continuous upstanding ridge formed around the periphery of the top face of said ferrite body and extending outwardly to at least a top surface of said at least one pair of electrical conductors and defining a recess at the top face of said ferrite body.

12. An electronic circuit according to claim 11 further comprising sealing means positioned within the recess defined by said upstanding ridge for forming a continuous top face to facilitate automated handling of the common mode choke.

* * * * *